US006721967B2

(12) United States Patent
Braxton

(10) Patent No.: US 6,721,967 B2
(45) Date of Patent: Apr. 20, 2004

(54) MODULAR PORTABLE COMFORT STATION

(76) Inventor: Earl J. Braxton, 3487 EastPointe, Shelby Township, MI (US) 48316

( * ) Notice: Subject to any disclaimer, the term of this patent is extended or adjusted under 35 U.S.C. 154(b) by 0 days.

(21) Appl. No.: 10/201,174

(22) Filed: Jul. 22, 2002

(65) Prior Publication Data

US 2004/0010847 A1 Jan. 22, 2004

(51) Int. Cl.[7] ..... A47K 4/00
(52) U.S. Cl. ..... 4/664; 4/321
(58) Field of Search ..... 4/663, 664, 321, 4/449, 459, 476, 625, 626; 52/79.1

(56) References Cited

U.S. PATENT DOCUMENTS

| | | | | | |
|---|---|---|---|---|---|
| 1,739,621 | A | * | 12/1929 | Wallace | 4/664 X |
| 2,817,091 | A | | 12/1957 | Painter | 4/664 |
| 3,423,766 | A | | 1/1969 | Eger | 4/321 X |
| 3,590,393 | A | * | 7/1971 | Hollander et al. | 4/663 |
| 3,835,480 | A | | 9/1974 | Harding | 4/459 |
| 4,214,324 | A | | 7/1980 | Kemper et al. | 4/321 X |
| 4,285,077 | A | | 8/1981 | Braxton | 4/462 |
| 4,377,875 | A | | 3/1983 | Brubakken | 4/321 X |
| 4,380,836 | A | | 4/1983 | Braxton | 4/449 X |
| 4,493,118 | A | | 1/1985 | Braxton | 4/449 X |
| 5,029,348 | A | | 7/1991 | Boren | 4/449 |
| 5,036,634 | A | * | 8/1991 | Lessard et al. | 52/79.1 |
| 5,093,941 | A | | 3/1992 | Muller | 4/479 |
| 5,251,342 | A | | 10/1993 | Sansom et al. | 4/462 |
| 5,379,466 | A | | 1/1995 | Davies | 4/449 |
| 5,500,960 | A | | 3/1996 | Tagg | 4/321 X |
| 5,500,962 | A | | 3/1996 | Tagg | 4/476 |
| 5,560,050 | A | | 10/1996 | Tagg | 4/449 |
| 5,615,420 | A | | 4/1997 | Guyton | 4/233 |
| 5,671,487 | A | | 9/1997 | Chen | 4/449 X |
| 5,682,622 | A | * | 11/1997 | Tagg | 4/449 |
| 5,704,078 | A | | 1/1998 | Chandler | 4/449 |
| 5,742,956 | A | | 4/1998 | Tarver | 4/663 |
| 5,913,610 | A | * | 6/1999 | Duck | 4/321 |
| 6,115,971 | A | * | 9/2000 | Loebertmann et al. | 4/449 X |
| 6,507,958 | B1 | * | 1/2003 | Tagg | 4/321 |

FOREIGN PATENT DOCUMENTS

| | | | | |
|---|---|---|---|---|
| DE | 2216026 | * | 10/1973 | 4/664 |
| FR | 2619842 | * | 3/1989 | 4/663 |
| GB | 1180566 | * | 2/1970 | 4/664 |

* cited by examiner

*Primary Examiner*—Robert M. Fetsuga
(74) *Attorney, Agent, or Firm*—VanOphem & VanOphem, P.C.

(57) ABSTRACT

A portable washroom for providing both washing and toilet facilities. The washroom is an enclosure that includes a base, upright supports mounted to the base, wall panels mounted between the upright supports, and a roof mounted to the top of the wall panels. An upward flushing toilet is mounted within the enclosure. The toilet has a waste line extending through one of the wall panels, and out of the enclosure so that waste from the flush toilet and wash basin is flushed outside of the enclosure. A wash basin is mounted within the enclosure and includes a drain line that connects to the toilet bowl waste line. A fresh water supply line extends through one of the wall panels of the enclosure and is fluidically connected to the toilet and to the wash basin for supplying fresh water thereto.

18 Claims, 5 Drawing Sheets

MODULAR PORTABLE COMFORT STATION

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to portable building structures. More specifically, this invention is directed to a portable and modular comfort station that features flexibility in construction to accommodate a variety of applications.

2. Description of the Related Art

Portable toilet shelters are widely used throughout the world at construction sites, outdoor public events, and other points-of-use having large gatherings of people. Portable toilet shelters generally include a base, four walls including a door, and a roof. Mounted within the typical shelter, a waste tank is positioned on the base and includes a top surface with an opening therethrough and a toilet seat hingably mounted over the opening. The waste material drops, under the influence of gravity, into the tank where it is accumulated for collection. The waste tank is pumped out through the toilet opening as needed.

A major disadvantage with the conventional portable toilet shelter is that the waste tank, and the waste therein, is open to the inside of the enclosure. This open condition subjects each user of the portable toilet to the unsightly waste in the waste tank and to the unpleasant odors emanating therefrom. A related problem is that chemicals must be added to the waste tank to reduce the odor and bacteria levels. Another disadvantage is that the typical portable toilet shelter has a limited waste capacity and requires interruption of use to pump the shelter out. Finally, since conventional portable shelters rely on gravity to flow waste to the storage tank, the conventional portable toilets must be elevated to accommodate a larger waste material storage tank that is positioned under the toilet, and such shelters require steps that are not handicap accessible.

U.S. Pat. No. 5,500,960 to Tagg discloses a portable toilet unit with a flush system that reduces offensive odors and that provides a more sanitary and less unsightly waste disposal system. Tagg teaches a waste storage tank having a toilet structure formed on its upper surface mounted within the portable toilet unit. A separate removable water supply tank is arranged outside of and at the rear surface of the toilet unit for providing a supply of fresh water. As an alternative to the fresh flushing water, a pipe connected to a filter is run into the waste material holding tank, so that filtered waste liquid in the waste material holding tank may be drawn through the pipe and through a control valve to the flushing mechanism when the pump is actuated. The control valve can be set to open either pipe to the flush mechanism or to close off both pipes so that the toiled may be used in any one of three ways, that is: with a fresh water flush; a recycled waste liquid flush; or as a static, no-flush system.

A solution to the problem of offensive odors wherein the waste material is flushed is an improvement over static, non-flush toilets. The solution taught by Tagg is not, however, optimal in that the waste material generating the odor is still stored within the toilet unit. Furthermore, the waste material storage tank has limited capacity since the waste is stored within the toilet unit and below the toilet seat level. The influx of fresh water with each flush will fill the relatively small waste material storage tank more quickly requiring frequent evacuation of the waste material through the toilet seat opening. The solution disclosed in Tagg wherein the system is flushed with recycled waste will be less efficient in addressing the problem of offensive odor than a fresh water flush because filtration processes are imperfect and will result in malodorous fluids being cycled within the toilet unit.

U.S. Pat. No. 5,913,610 to Duck teaches a toilet enclosure having a flush toilet and waste tanks separate from the waste bowl of the toilet to reduce the problem of odors internal to the toilet enclosure. This invention includes the flush toilet mounted within the enclosure and connected via an outlet pipe extending through a wall of the enclosure to a lower waste tank. The lower waste tank is positioned outside and in back of the enclosure. An upper waste tank is mounted atop the lower waste tank and holds a flush mixture composed of an initial charge of fresh water as well as recirculated liquid waste from the lower waste tank.

Upon flushing the Duck toilet, part of the flush mixture flows under the force of gravity from a cistern of the flush toilet into the waste bowl of the flush toilet. The contents of the waste bowl are thus evacuated through the outlet pipe into the lower waste tank. Another part of the flush mixture is pumped from the upper waste tank into the cistern of the flush toilet to replace that portion of the flush mixture that was flushed into the waste bowl. The lower waste tank holds both solid and liquid waste, but includes a pump to transfer the liquid waste into the upper waste tank. As such, the upper waste tank stores the liquid waste in solution with the initial charge of fresh water. Before long, the initial charge of fresh water is recirculated such that it is thoroughly contaminated with liquid waste.

A major drawback with the Duck approach is that the primary object of Duck is destroyed by Duck's own teachings. In other words, Duck aims to eliminate waste odor from within a portable toilet enclosure by removing the odor source to the outside of the enclosure. In part, Duck succeeds by relocating the solid waste to the outside of the enclosure. Ultimately, however, Duck fails to accomplish the primary goal of eliminating waste odors because Duck teaches recycling the malodorous liquid waste back into the cistern inside the enclosure. Such a design may be an efficient use of liquid waste, but it certainly teaches away from removing the source of odor from within the enclosure. In fact, Duck teaches adding chemicals to the liquid waste tank to attempt to control such odor. Unfortunately, however, chemicals can be expensive, high maintenance, ineffective, and malodorous in and of themselves. Moreover, Duck fails to provide a wash basin with which users can wash up after using the toilet. Additionally, Duck fails to teach a portable toilet facility that is modular and therefore easily expandable. Finally, Duck requires electricity hookups to run the pumps and switches necessary to operate the toilet.

From the above, it can be appreciated that portable toilet shelters of the prior art are not fully optimized to reduce objectionable odors from within the enclosure. Therefore, what is needed is a washroom that does not require electricity, that is handicap accessible, portable, modular, provides washroom fixtures that people are familiar with and comfortable in using, and that does not recycle waste products within the enclosure.

BRIEF SUMMARY OF THE INVENTION

According to the preferred embodiment of the present invention, there is provided a portable and modular comfort station or washroom including an enclosure, a wash station, and a flush toilet.

The enclosure includes a base, supports, wall panels, a door panel and a roof. Preferably, the upright supports are mounted perpendicularly to the base. The door panel and the wall panels are mounted between the upright supports. The roof is attached to the top of the upright supports and the wall panels.

The flush toilet includes a toilet bowl, a toilet tank, a waste line and a waste tank. The toilet bowl is mounted to the base within the enclosure. The waste tank is positioned outside and behind the enclosure. The toilet bowl is connected to a waste line that extends outside the enclosure such that the odor from any waste disposal will not contaminate the area within the enclosure. The waste line is connected to the holding tank. The waste line may, however, terminate over a sewage drain or septic field in alternate embodiments. A toilet tank is mounted above the toilet bowl to one of the wall panels. The toilet tank is fluidically connected, such that fluid flows therethrough, to the toilet bowl and provides fresh water for flushing the toilet bowl.

The wash basin is mounted within the enclosure to a wall panel and includes a drain line extending therefrom that connects to the waste line. A fresh water supply line extends through one of the wall panels of the enclosure and is fluidically connected to the toilet tank and to the wash basin for supplying fresh water thereto. Alternately, an on-demand tankless gas heater can be used to heat the fresh water to provide hot tap water out of the wash basin.

It is an object of the present invention to provide a handicap accessible portable washroom that is simpler, private, comfortable, more sanitary and that more effectively reduces undesirable odor than the prior art.

It is another object to eliminate the need for pumps and fluid level switches, and thus eliminate the necessity of electricity hookups to run the portable washroom.

It is still another object that the portable washroom does not recycle any waste, either solid or liquid, through the toilet as the prior art requires.

It is yet another object to eliminate the need for chemical treatment to suppress waste odors within the enclosure.

It is still yet another object to provide a portable washroom that is handicap accessible/compatible.

It is a further object to provide a modular portable washroom that is easily expandable to accommodate more people than the prior art.

It is still a further object to provide a wash basin within the portable washroom and further provide hot tap water for the convenience and comfort of the user.

It is yet a further object to use a readily available garden hose to supply fresh water from any reasonably available water source such as a tank, well, or nearby building.

It is still yet a further object to provide a portable washroom that is easily maintained and/or repaired in the field.

It is another object to provide a portable washroom that is adapted to implement an existing septic system or sewer system such that pumping service is not required.

It is another object to provide a safe and secure portable washroom without violating the privacy of a user.

These objects and other features, aspects, and advantages of this invention will be more apparent after a reading of the following detailed description, appended claims, and accompanying drawings.

DETAILED DESCRIPTION OF THE PREFERRED EMBODIMENT

Generally shown in the Figures, a portable and modular comfort station or washroom is provided in accordance with the present invention. As used herein, the term washroom is synonymous with the term restroom and in general means a structure having at least a sink and a flush style toilet therein. The term modular is used herein with regard to a structure that is constructed on the basis of a standard pattern or dimensions, and is easily expanded or joined with other like structures. The term portable is synonymous with transportable and means capable of being carried in a relatively easy and convenient fashion.

Figure 1:
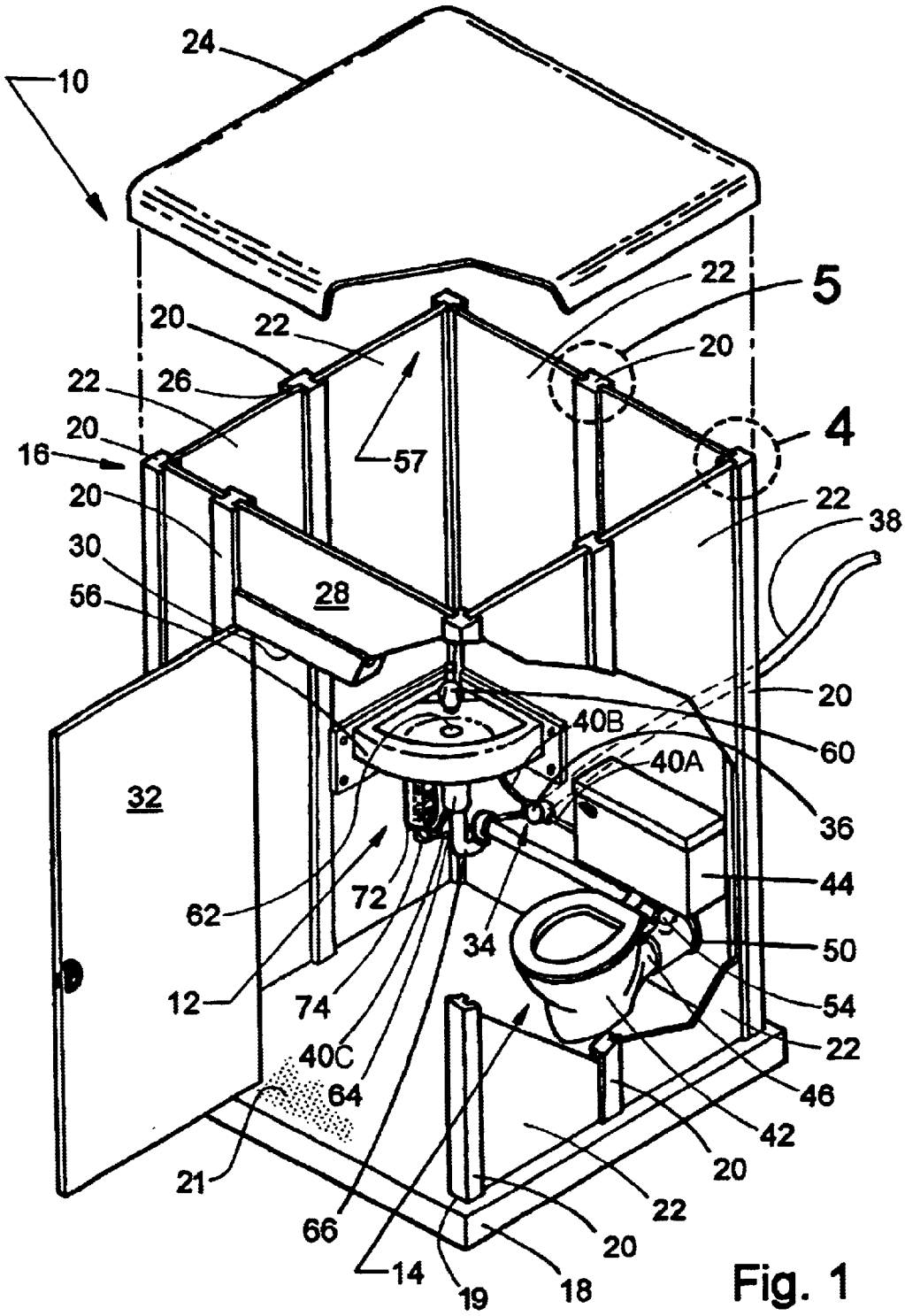
FIG. 1 is a perspective view of the modular washroom according to the preferred embodiment of the present invention.

Referring now in detail to the Figures, there is shown in FIG. 1 a comfort station or washroom 10 according to the preferred embodiment of the present invention that is both portable and modular in construction. The washroom 10 includes a wash station 12 and a toilet 14 mounted within an enclosure 16. The wash station 12 and toilet 14 are preferably composed of porcelain, however, it should be appreciated that wash stations and/or toilets composed of other materials such as ceramic, plastic, metal, etc. can be envisioned.

Figure 4:
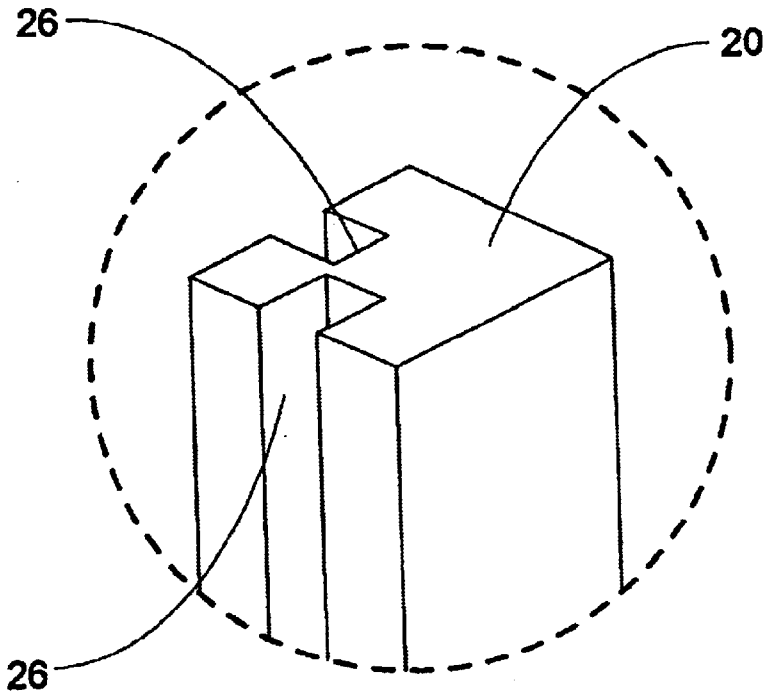
FIG. 4 is an enlarged perspective view of the upright support element shown in circle 4 of FIG. 1.
Figure 5:
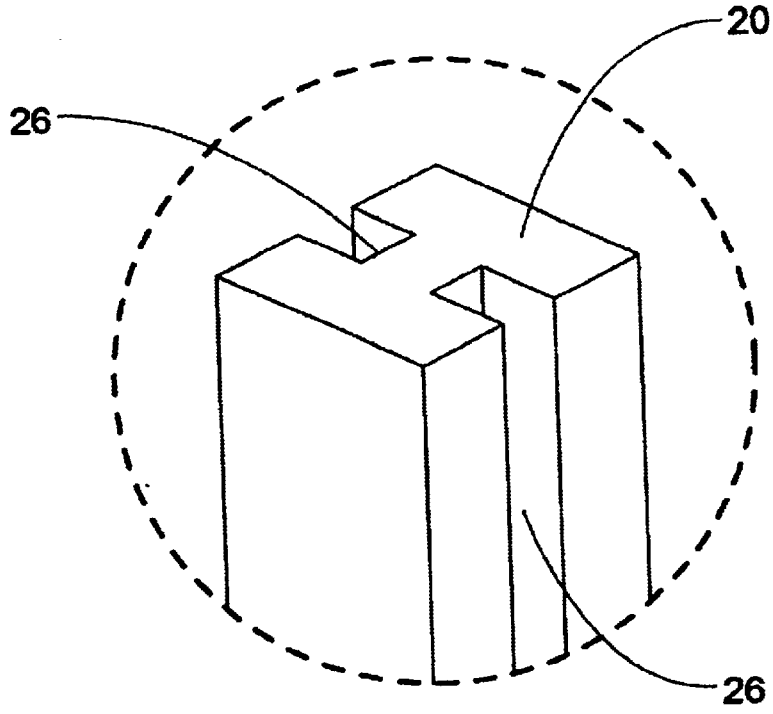
FIG. 5 is an enlarged perspective view of the upright support element shown in circle 5 of FIG. 1.

The enclosure 16 includes a base 18, upright supports 20, wall panels 22, and a roof 24. The base 18 is preferably constructed using a rotational casting process (roto-cast), and includes integral sockets 19 to receive the upright supports 20. The base 18 further includes a non-skid floor material 21 applied thereto as a sanitary top surface. The roof 24 preferably includes a ventilation hole (not shown), however, it should be appreciated that a similar ventilation hole can also be provided in one of the wall panels 22. The wall panels 22 are preferably made from opaque polyethylene while the roof 24 is preferably made from a relatively transparent polyethylene, but both can be made of any other cost-effective materials. The upright supports 20 are preferably made from readily available extruded aluminum, but could also be composed of injection molded plastic. Each upright support 20 includes longitudinally extending grooves 26, as best shown in FIGS. 4 and 5, for accepting the edges of the wall panels 22. It is contemplated that the upright supports 20 could be extruded with one longitudinal groove 26 per side to provide increased modularity.

Referring again to FIG. 1, once the upright supports 20 are installed into the respective sockets within the base 18, the wall panels 22 are slid into the corresponding grooves 26 of the upright supports 20. Alternatively, one side edge of each wall panel 22 can be inserted into a corresponding groove 26 in one upright support 20, then the wall panel 22 can be bowed horizontally to permit an opposite side edge of the wall panel 22 to be inserted into a corresponding groove in an adjacent upright support 20. The wall panels 22 are interchangeable to facilitate maintenance and repair of the comfort station 10 in the field, whereby a damaged wall panel 22, including any attachments thereto, is removed and replaced with a new wall panel 22. One of the wall panels 22 is a door wall panel 28 that includes a door opening 30 and hinged door 32. The door wall panel 28 is installed between adjacent upright supports 20 to provide access to the inside of the washroom 10. Finally, the roof 24 is mounted atop the assembled upright supports 20 and wall panels 22, and can be fastened thereto using any well-known method including using plastic Xmas-tree fasteners, zip ties, or the like.

According to a preferred embodiment of the present invention, a plurality of mirrors (not shown) are disposed at predetermined locations within the enclosure 16 as a safety measure. The placement of the mirrors permit a perspective user to quickly inspect the interior of the enclosure 16, without having to enter the enclosure 16, simply by opening the door 32. The mirrors disposed within the enclosure 16 as described herein therefore provide added security without violating the privacy of a user.

Figure 2:
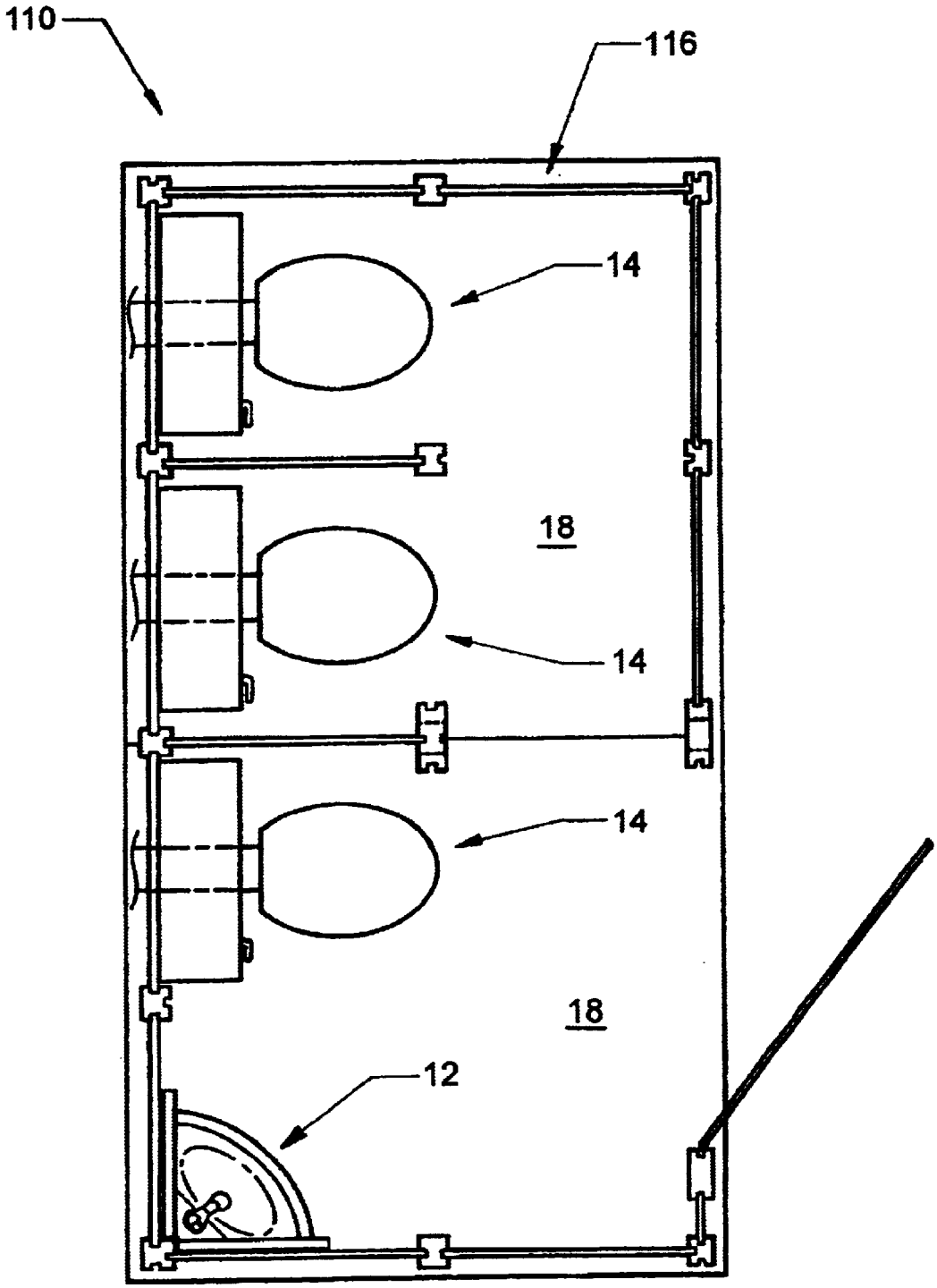
FIG. 2 is a top view of the modular washroom of FIG. 1 that has been expanded to include additional toilets according to an alternate embodiment of the present invention.

Referring briefly to FIG. 2, there is shown an expanded comfort station or washroom 110 according to an alternate embodiment of the present invention. The expanded washroom 110 includes an expanded enclosure 116, two bases 18, three toilets 14 and a wash station 12. The expanded enclosure 116 includes the same elements included in the enclosure 16 (i.e. upright supports 20, wall panels 22 and roofs 24). In accordance with the description above, the expanded enclosure 116 is attached on top of two adjacent bases 18. Furthermore, the expanded washroom 110 is adapted to accommodate additional wall panels 22 and/or additional door wall panels 28 within the expanded enclosure 116 to provide additional privacy for configurations having multiple adjacent toilets 14. It should be appreciated that FIG. 2 represents one possible configuration for the expanded washroom 110, and that the modularity of the washroom 10 allows for the construction of the expanded washroom 110 to include any combination of multiple bases 18, toilets 14.and wash stations 12. Alternatively, it is envisioned that the multiple bases 18 could be incrementally elevated such that a single fresh water supply (not shown) could be provided to the highest portion of the washroom 110 and transferred by gravity to the consecutive lower sections of the washroom 110.

Referring again to FIG. 1, a fresh water supply line 34 includes a fresh water supply hose 38 and a bulkhead fitting 36 that extends through one of the wall panels 22, preferably at the rear of the enclosure 16. The bulkhead fitting 36 is used for external connection to the water supply hose 38 and for internal connection to the wash station 12 and toilet 14. Outside of the enclosure 16, the bulkhead fitting 36 is preferably a ½ inch threaded hose fitting. Inside the enclosure 16, the bulkhead fitting 36 is preferably a three-way branch fitting for connecting to flexible tubing 40A, 40B and 40C that connects to the wash station 12 and toilet 14. The fresh water supply hose 38 is connected to an externally mounted water tank (not shown), well, nearby building or any other convenient source of fresh water.

The toilet 14 is preferably either a Denbigh or Adelphi model available from Shires Limited in Bradford, England. The Shires toilets include a waste bowl or toilet bowl 42 and a cistern or toilet tank 44. The Shires toilets are preferred because they include a P-trap portion 46 that is integrated into the waste bowl 42. This enables upward and rearward ejection of waste rather than downward ejection, thus eliminating the need for space beneath the waste bowl 42 for a separate, bulky S-trap in the waste conduit as used in conventional toilets. The waste bowl 42 is secured to the base 18 of the enclosure 16 by four screws or bolts (not shown) extending through holes in the bottom of the waste bowl 42. The cistern 44 is mounted above the toilet 14 to one of the wall panels 22 by a pair of brackets and a set of screws (not shown) as is well known in the art. The cistern 44 provides fresh water from the fresh water supply line 34 to the toilet 14 such that the toilet 14 is flushed with fresh water. As the cistern 44 is mounted above the toilet 14, the toilet 14 is flushed under the influence of gravity thereby eliminating the need for pumps and fluid level switches such that electricity hookups are not required to operate the washroom 10. Alternatively, the washroom 10 can be configured to accommodate electricity hookups to facilitate operation of the wash station 12 and/or toilet 14.

Figure 6:
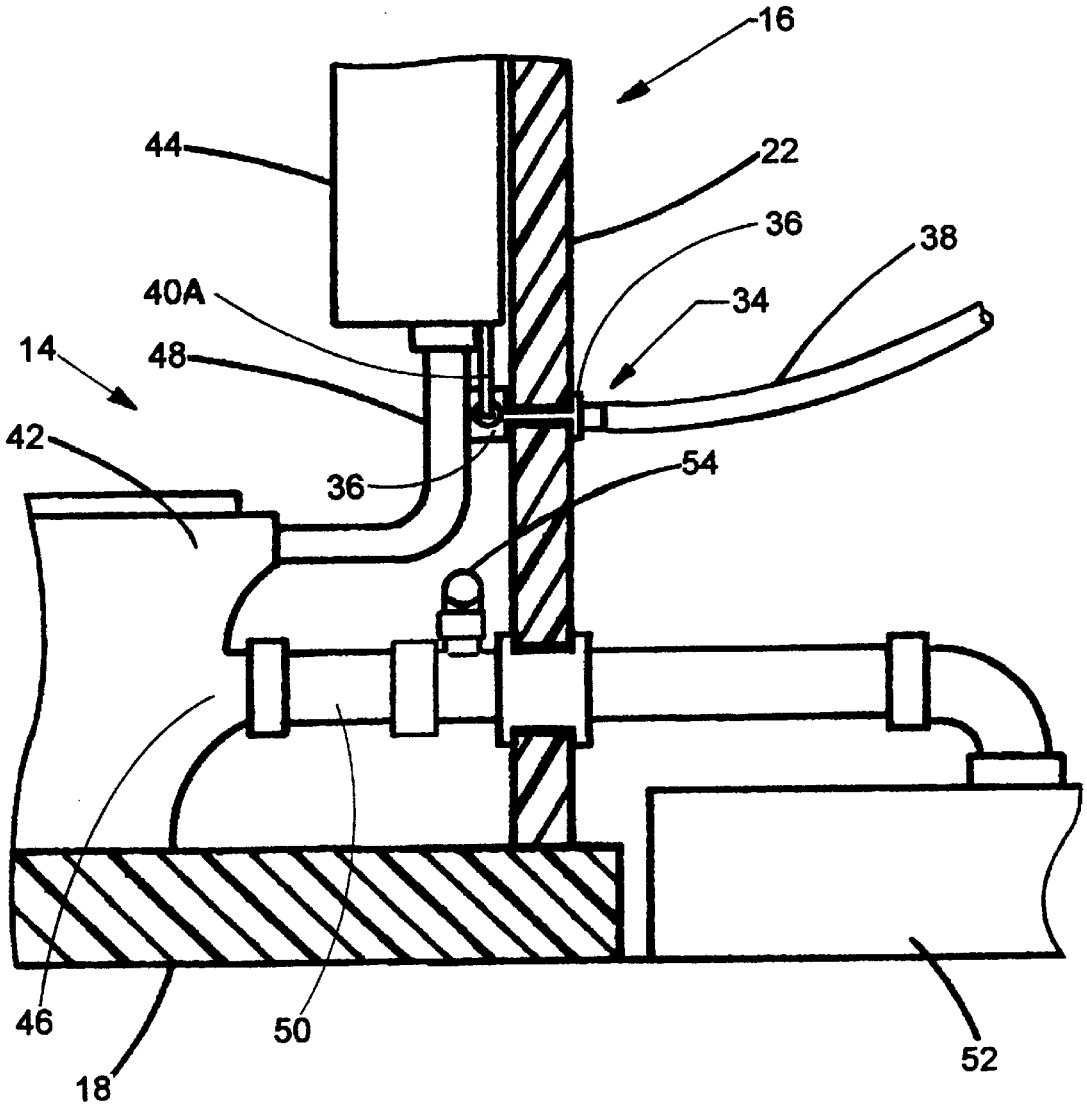
FIG. 6 is an enlarged cross-sectional view of the flush toilet assembly shown in FIG. 1.

As shown in FIG. 6, a flexible conduit 48 connects the cistern 44 to the waste bowl 42, to supply a fresh water flush thereto. In turn, the cistern 44 is supplied with fresh water from the water supply hose 38 through the bulkhead fitting 36 and flexible tubing 40A. A rigid waste line 50, preferably composed of PVC pipe and fittings, extends from the integral P-trap 46 and through one of the wall panels 22 to the exterior of the enclosure 16. The waste line 50 preferably terminates in a connection to a waste holding tank 52. Alternately, the waste line 50 can be attached in fluid communication to a septic system or sewage drain such that the washroom 10 (shown in FIG. 1) does not require pumping service.

The waste holding tank 52 is preferably a relatively flat rectangular container that is sized to fit within the enclosure 16 for efficiently transporting the washroom 10 and holding tank 52 as a single unit. When the holding tank 52 is full, it can be immediately serviced and/or replaced with an empty holding tank. Alternately, the holding tank 52 can be pumped out from outside of the enclosure 16. In either case, operation of the washroom 10 need not be interrupted. Just inside the enclosure 16, the waste conduit includes a T-branch 54 for accepting waste water from the wash station 12 such that the waste water from the wash station 12 and the toilet 14 are disposed of through the same waste line 50. The waste holding tank 52 is preferably located outside and behind the enclosure 16 while in use so that the user of the washroom 10 is not subjected to the unsightly waste in the holding tank 52 and to the unpleasant odors emanating therefrom. Additionally, as the holding tank 52 is behind and not underneath the enclosure 16, it is not necessary to elevate the washroom 10 thereby rendering the washroom 10 handicap accessible.

Figure 3:
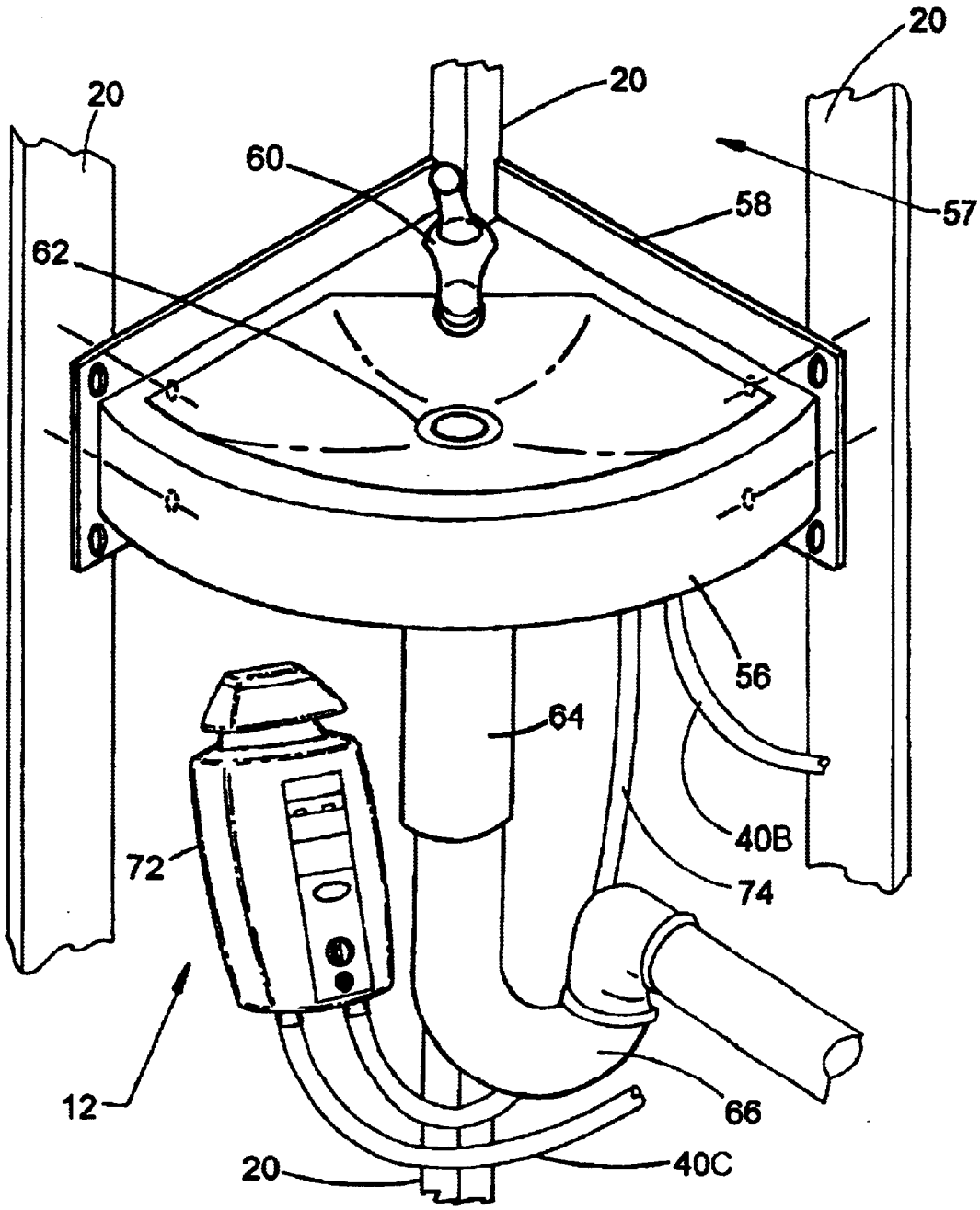
FIG. 3 is a perspective view of a wash station of the modular washroom of FIG. 1.

Referring now to FIGS. 1 and 3, the wash station 12 includes a wash basin or sink 56 that is mounted to the upright supports 20 at an inside corner 57 of the wash room 10. As shown, a mounting plate 58 is used to secure the sink 56 to the washroom 10 and to ensure that fasteners (not shown) align with the upright supports 20 to maximize rigidity. The sink 56 is a standard porcelain corner sink equipped with a standard single-valve faucet 60. The sink 56 includes a drain 62 that is connected to a drain line 64 that includes a P-trap 66. The drain line 64 extends downwardly toward the toilet 14 where it connects to the waste line 50. A water heater 72 is included to provide hot water to the sink 56. The water heater 72 is preferably an on-demand tankless gas heater, as exemplified by the Takagi and Paloma brands. Related technical information is readily available from these manufacturers or via www.gaswaterheaters.com which information is incorporated by reference herein. As is typical, a hot water output line 74 extends from the water heater 72 to the faucet 60. The water heater 72 is preferably supplied with a portable propane tank (not shown) that is positioned beneath the sink 56 in the corner of the enclosure 16. Alternatively, the wash station 12 can include a cabinet (not shown) mounted to the upright supports 20 beneath the sink 56.

As best shown in FIG. 1, the sink 56 is supplied with water flowing through the bulkhead fitting 36 and through the flexible tubing 40B and 40C as shown. A cold water line of the flexible tubing 40B extends from the bulkhead fitting 36 to the faucet 60, according to standard faucet connections. A hot water line of the flexible tubing 40C extends from the bulkhead fitting 36 to the gas fired water heater 72 that is mounted underneath the sink 56.

The washroom 10 is delivered to a point-of-use either fully assembled with the holding tank 52 and waste line 50 stored inside the enclosure 16, or is delivered in a disassembled state for on-site assembly. In either case, on-site preparation is minimal compared to the prior art. First, the holding tank 52 is placed outside of the enclosure 16 and the waste line 50 connected between the holding tank 52 and the toilet 14. Then, a length of the water supply hose 38 is externally connected to the bulkhead fitting 36 and the washroom 10 is operational. The length of water supply hose 38 is easily connected to a water supply truck, a water tank, a well source, or a building with running water if conveniently available.

Accordingly, the present invention is superior to the prior art for several reasons. Primarily, the portable washroom according to the present invention does not recycle any waste through the toilet fixtures and thus eliminates any related odors and the need for chemical treatment. Additionally, the portable washroom includes not only a porcelain toilet but also includes a porcelain wash basin with fresh, hot and cold running water. A user can wash up after using the toilet, thus rendering the present invention more versatile and desirable to a wider base of clientele. Furthermore, the portable washroom does not require electricity hook ups to operate. Finally, the portable washroom is modular and therefore easily-expandable to more efficiently service greater numbers of people.

While the present invention has been described in terms of a preferred embodiment, it is apparent that other forms could be adopted by one skilled in the art. In other words, the teachings of the present invention encompass any reasonable substitutions or equivalents of claim limitations. Accordingly, the scope of the present invention is to be limited only by the following claims.

What is claimed is:

1. A portable comfort station comprising:

an enclosure comprising:

a base;

a plurality of walls mounted to said base, at least one of said plurality of walls having a door opening therein; and a roof mounted to said plurality of walls;

a flush toilet mounted within said enclosure, said flush toilet comprising:

a toilet bowl mounted to said base;

a waste line attached to said toilet bowl and extending therefrom outside said enclosure; and a toilet tank mounted above said toilet bowl, said toilet tank being fluidically connected to said toilet bowl for flushing said toilet bowl;

a wash basin mounted within said enclosure, said wash basin comprising a drain outlet;

means for supplying fresh water fluidically connected to said toilet tank and to said wash basin for supplying fresh water thereto, said means for supplying fresh water comprising a bulkhead connector mounted through one of said plurality of walls; and a fresh water supply source, said source connected to said bulkhead connector externally of said portable comfort station; and a drain line fluidically connected to said drain outlet and said waste line.

2. The portable comfort station as claimed in claim 1 further comprising a holding tank positioned externally of said enclosure, said holding tank being fluidically connected to said waste line for receiving waste from said flush toilet and said wash basin.

3. The portable comfort station as claimed in claim 1, wherein said wash basin is a corner sink mounted to an inside corner of said enclosure.

4. The portable comfort station as claimed in claim 1 further comprising a portable water heater fluidically interposed said means for supplying fresh water and said wash basin.

5. The portable comfort station as claimed in claim 1 further comprising means for quickly and easily attaching a plurality of said portable comfort stations together to form a single, larger structure capable of accommodating more people.

6. A portable comfort station comprising:

a modular enclosure comprising:

a base;

a plurality of supports mounted to said base;

a plurality of walls mounted to said base, at least one of said plurality of walls having a door opening therein; and a roof mounted atop said plurality of walls;

a flush toilet mounted within said modular enclosure, said flush toilet comprising:

a toilet bowl mounted to said base;

a waste line attached to said toilet bowl and extending therefrom outside said enclosure; and a toilet tank mounted to one of said plurality of walls and elevated with respect to said toilet bowl, said toilet tank being fluidically connected to said toilet bowl for flushing said toilet bowl;

a wash basin mounted to at least one of said plurality of supports within said modular enclosure, said wash basin comprising a drain outlet;

means for supplying fresh water fluidically connected to said toilet tank and to said wash basin for supplying fresh water thereto;

a drain line fluidically connected to said drain outlet of said wash basin and said waste line of said toilet bowl of said flush toilet; and a portable water heater fluidically interposed said means for supplying fresh water and said wash basin.

7. The portable comfort station as claimed in claim 6, wherein said means for supplying fresh water comprises a bulkhead connector mounted through one of said plurality of walls of said modular enclosure and further comprises a fresh water supply hose connected to said bulkhead connector externally of said portable comfort station.

8. The portable comfort station as claimed in claim 6, wherein said flush toilet includes an integral P-trap to prevent odors from backing up into said modular enclosure.

9. The portable comfort station as claimed in claim 6 further comprising a holding tank positioned externally of said modular enclosure, said holding tank being fluidically connected to said waste line for receiving waste from said flush toilet and said wash basin.

10. The portable comfort station as claimed in claim 6 further comprising means for quickly and easily attaching a plurality of said portable comfort stations together to form a single, larger structure capable of accommodating more people.

11. The portable comfort station as claimed in claim 6, wherein said wash basin is a corner sink mounted to an inside comer of said modular enclosure.

12. The portable comfort station as claimed in claim 6, wherein said base is roto-cast to include a plurality of integral sockets adapted to receive said plurality of supports.

13. The portable comfort station as claimed in claim 6, wherein said base further comprises a sanitary, non-skid floor material applied thereto.

14. The portable comfort station as claimed in claim 6, wherein said waste line further comprises means for disposing waste into a sewer system whereby said portable comfort station does not require pumping service.

15. A portable comfort station comprising:

a modular enclosure comprising:

a base;

a plurality of supports mounted to said base, said plurality of supports having a plurality of longitudinally extending grooves;

a plurality of walls mounted between said plurality of supports within said plurality of longitudinally extending grooves, at least one of said plurality of walls having a door opening therein; and a roof mounted atop said plurality of walls;

a flush toilet mounted within said modular enclosure, said flush toilet comprising:

a toilet bowl mounted to said base, said toilet bowl having an integral P-trap;

a waste line attached to said toilet bowl and extending therefrom through one of said plurality of walls and outside said modular enclosure; and a toilet tank mounted to one of said plurality of walls and elevated with respect to said toilet bowl, said toilet tank being fluidically connected to said toilet bowl for flushing said toilet bowl;

a wash basin mounted to at least one of said plurality of supports within said modular enclosure, said wash basin comprising a drain outlet;

means for supplying fresh water fluidically connected to said toilet tank and to said wash basin for supplying fresh water thereto;

a drain line fluidically connected to said drain outlet of said wash basin and said waste line of said toilet bowl of said flush toilet; and a portable water heater fluidically interposed said means for supplying fresh water and said wash basin.

16. The portable comfort station as claimed in claim 15 further comprising means for quickly and easily attaching a plurality of said portable comfort stations together to form a single, larger structure capable of accommodating more people.

17. The portable comfort station as claimed in claim 15, wherein said base is roto-cast to comprise a plurality of integral sockets adapted to receive said plurality of supports, said base further comprising a sanitary, non-skid floor material applied thereto.

18. The portable comfort station as claimed in claim 15, wherein said portable comfort station comprises a holding tank positioned externally of said modular enclosure, said holding tank being fluidically connected to said waste line for receiving waste from said flush toilet and said wash basin.

* * * * *